US006338400B1

(12) United States Patent
Wu

(10) Patent No.: US 6,338,400 B1
(45) Date of Patent: Jan. 15, 2002

(54) HANDLE ASSEMBLY WITH A PROTECTOR FOR LUGGAGE

(75) Inventor: Chen Yao Wu, Taipei Hsien (TW)

(73) Assignee: Hersun Plastic Co., Ltd., Taipei Hsien (TW)

( * ) Notice: Subject to any disclaimer, the term of this patent is extended or adjusted under 35 U.S.C. 154(b) by 0 days.

(21) Appl. No.: 09/692,234

(22) Filed: Oct. 20, 2000

(51) Int. Cl.[7] ..... A95C 13/26
(52) U.S. Cl. ..... 190/39; 16/113.1
(58) Field of Search ..... 16/113.1; 190/115, 190/18 A, 118, 3 G

(56) References Cited

U.S. PATENT DOCUMENTS 6,148,478 A * 11/2000 Kuwayama ..... 16/113.1
6,247,203 B1 * 6/2001 Kuo ..... 16/113.1

* cited by examiner

*Primary Examiner*—Gary E. Elkins
*Assistant Examiner*—Lien Ngo
(74) *Attorney, Agent, or Firm*—Rosenberg, Klein & Lee

(57) ABSTRACT

A handle assembly with a protector for luggage, which is formed with a caved recess on the top of the luggage where the pulling-rod handle is positioned, and a notch defined above the cave recess. The protector of the handle assembly is characterized that both lateral sides of the notch respectively have a bottom end with leading edge for latching. A plurality of apertures is defined through the bottom portion of the notch. A flexible spring plate member is received within the notch, and two hooks are fixed on both sides thereof. An upper plate portion of the member is fixed with a plurality of posts, and each of the posts is circumambulated arround by a spring with the end of the spring retained on the bottom of the upper plate portion. In assembly, the hooks of the spring plate member are latchingly snapped with the associated leading edges of the notch, and the posts are inserted through the apertures of the notch.

3 Claims, 5 Drawing Sheets

HANDLE ASSEMBLY WITH A PROTECTOR FOR LUGGAGE

BACKGROUND OF THE INVENTION

1. Field of the Invention

The invention relates to a handle assembly with a protector for luggage, and particularly to a luggage with a recess for pulling rods, disposed with a flexible spring plate member having specific structure. While the handle is retractably stored therein, it can be avoided that the hand to operate the handle directly bumps against the top of the luggage or is clamped hurtfully under the handle. Therefore, it can get a safety operation for any user.

2. Description of the Prior Art

As shown in FIGS. 1 & 2, a pulling-rod structure of a common conventional luggage is attached thereon with an upper retaining saddle (2) having an upper retaining platform (1) which are made of hard materials. While the user hold the handle in hand to press the rod down, the operating hand may directly bumps against the conjunction of the upper retaining platform (1) to be hurt or tightly clamped under the handle. Such disadvantage to safety operation should be resolved.

SUMMARY OF THE INVENTION

The present invention is directed towards overcoming one or more of the above disadvantages.

An object of the present invention provides a handle assembly with a protector for luggage. Meanwhile, a recess defined above the luggage can accommodate a flexible spring plate member thereby avoiding the hand from bumping against the top of the luggage or being hurtfully clamped under the handle for safety operation.

A second object of the present invention provides a handle assembly with a protector for luggage. Meanwhile, the flexible spring plate member that is capable to rise/fall in follow of variation of external force for protecting the hand is made of a material partially identical/consistent with the top of the luggage in color. Thus, the entire luggage can appear in consistence of visional effect.

Another object of the present invention provides a handle assembly with a protector for luggage. Meanwhile, the flexible spring plate member is capable to relatively balance most of the applied forces acting on the handle which is touched by the user. Thus, it can really win safety operation.

To achieve the above objects, there is provided a handle assembly with a protector for luggage, which including: a notch formed on the top of the luggage, the notch having a bottom end with leading edges on both of lateral sides thereof; and a flexible spring plate member received within the notch, and two hooks are fixed on both sides thereof, and at least a spring retained in the bottom of an upper plate portion of the member with an end of the spring fixed on the bottom surface of the upper plate portion.

In assembly, the hooks of the flexible spring plate member are retentively snapped with the associated leading edges of the notch, and the spring is disposed between the bottom of the upper plate portion of the flexible spring plate member and the bottom of the notch.

BRIEF DESCRIPTION OF THE DRAWING

These and other objects of the present invention will be readily understood upon consideration of the following detailed description and attached drawing, wherein.

Figure 1:
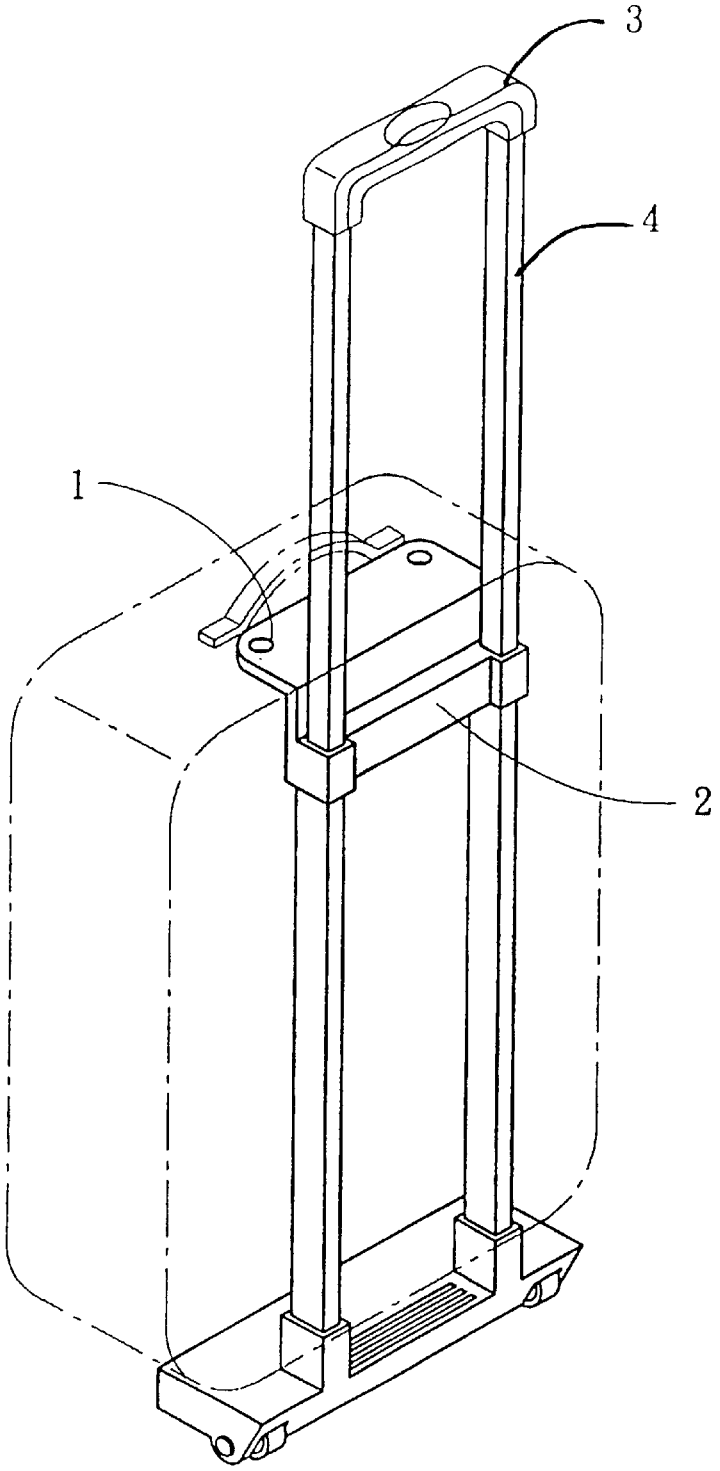
FIG.1 (PRIOR ART)
FIG. 1 is an assembled perspective view showing a conventional luggage with pulling rods.
Figure 2:
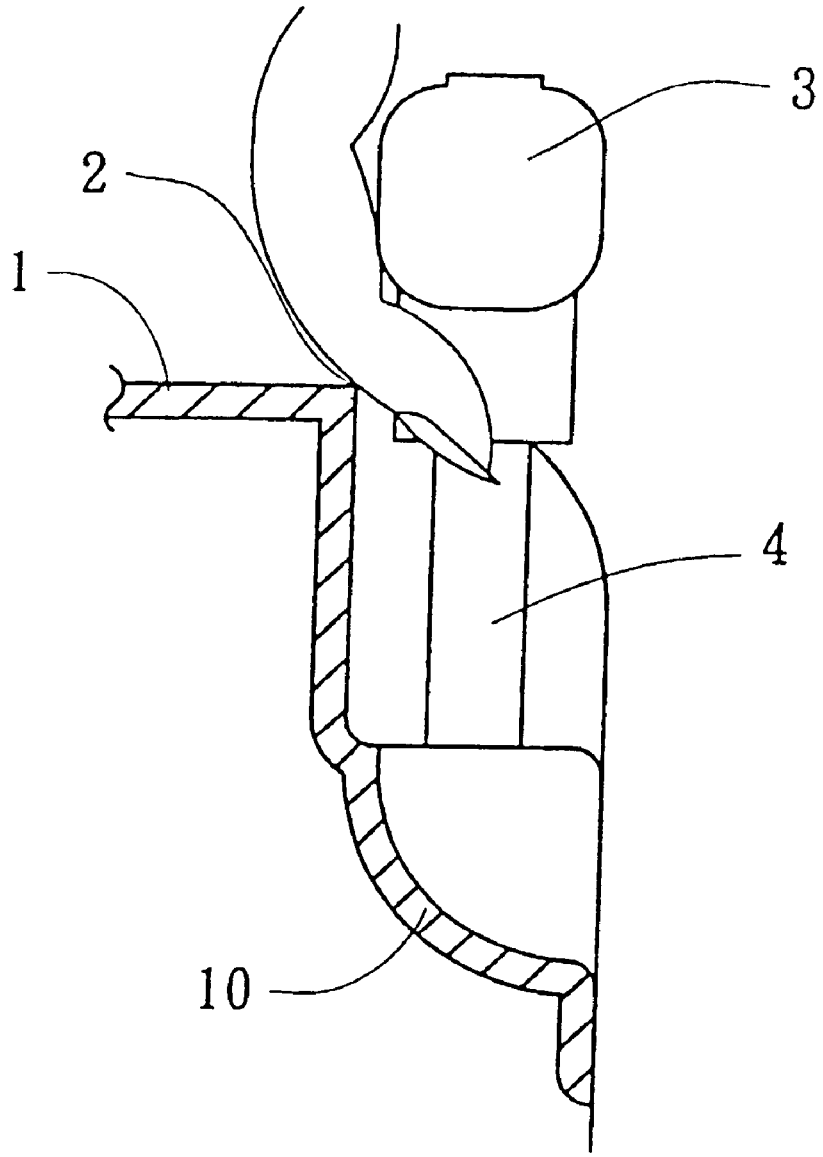
FIG.2 (PRIOR ART)
FIG. 2 is an active schema showing the pulling-rod handle of the luggage of FIG. 1. is received therein.
Figure 3:
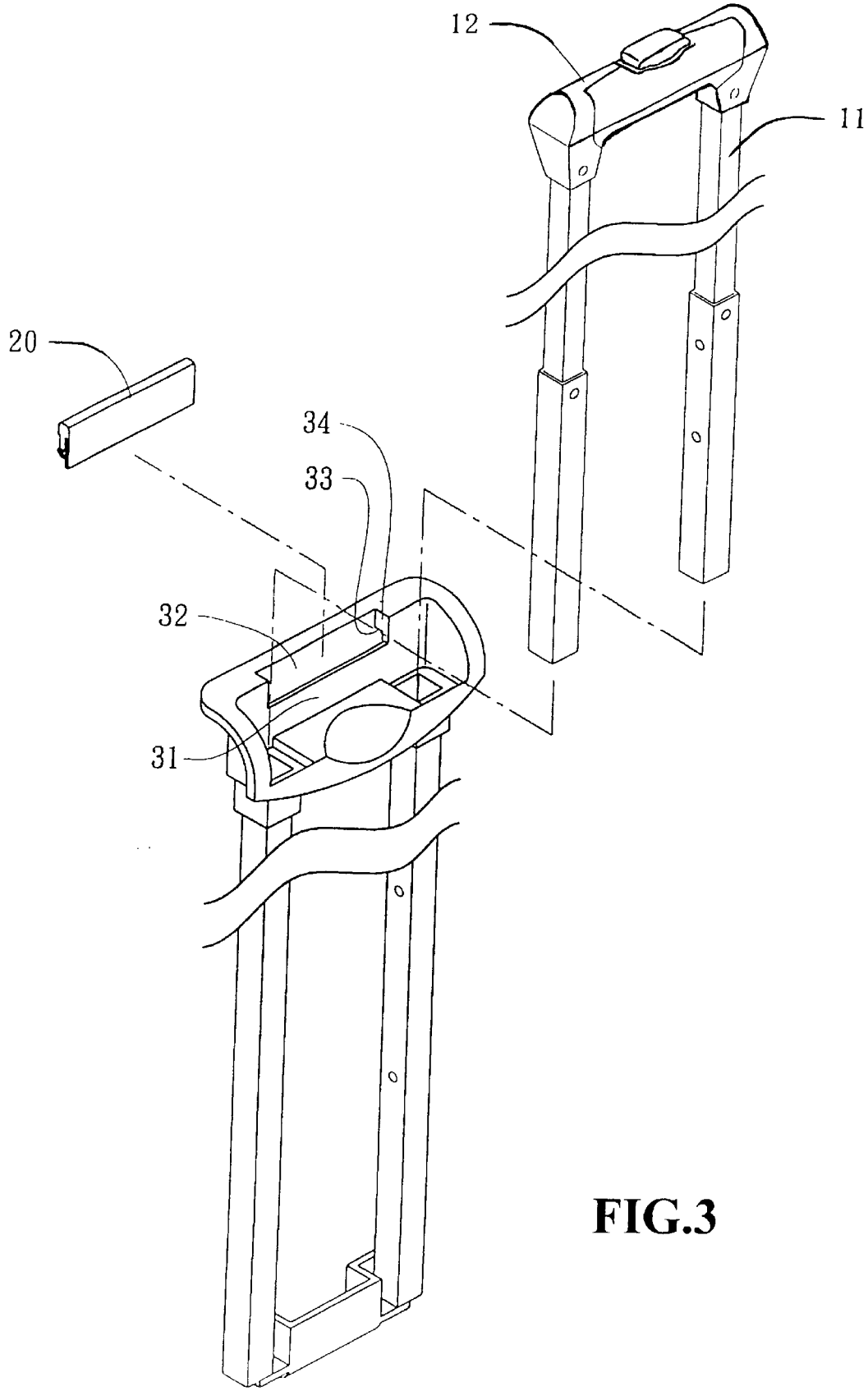
Figure 4:
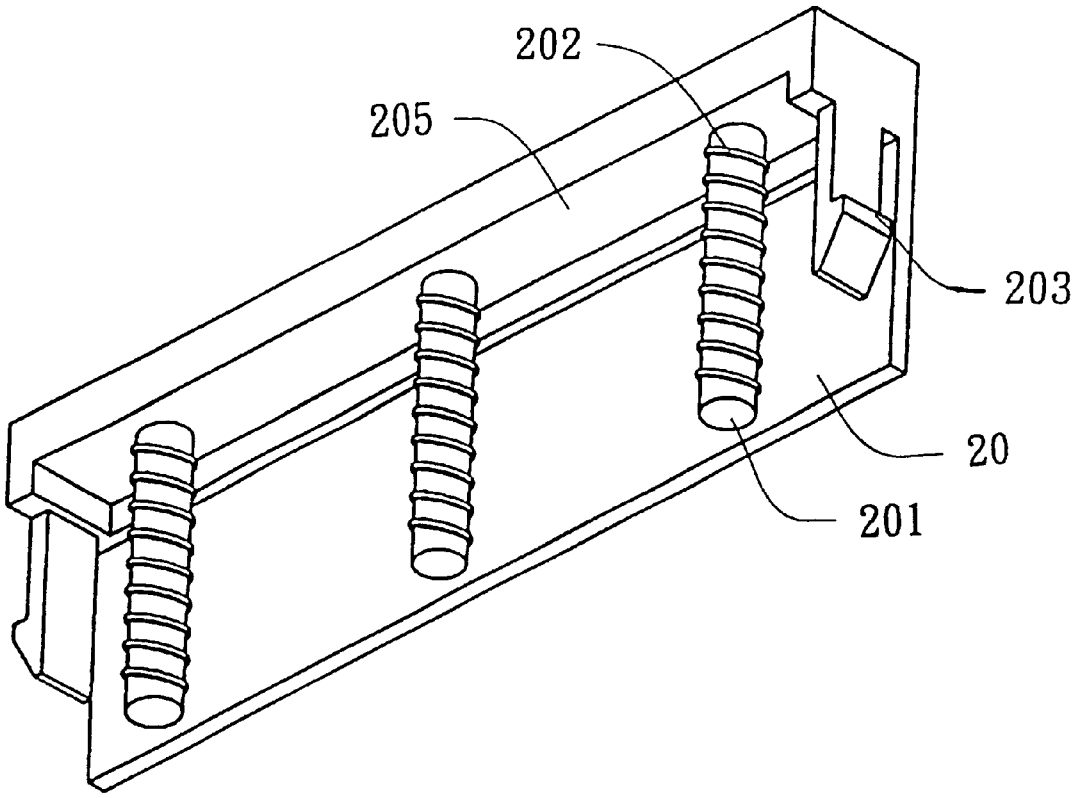
Figure 5A:
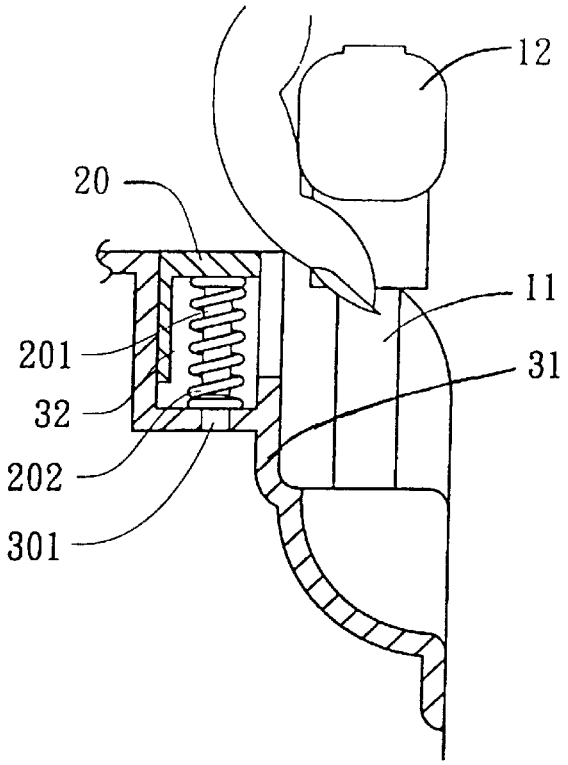
Figure 5B:
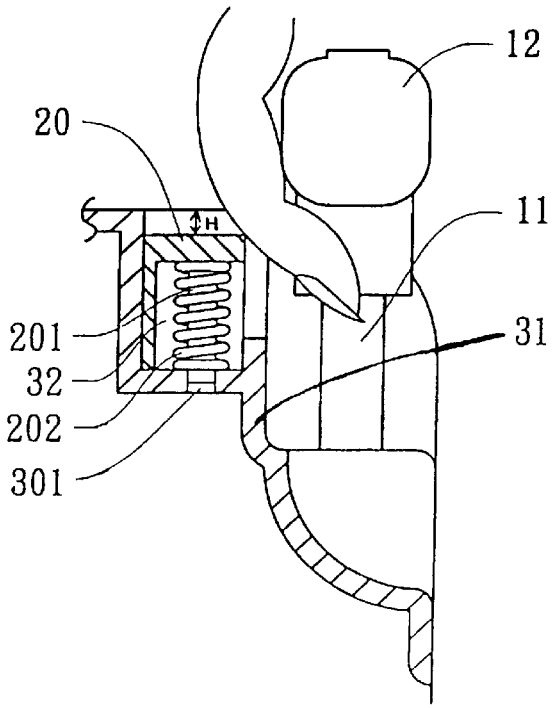

a preferred embodiment in accordance with the present invention;

FIG. 3 is an exploded perspective view showing a preferred embodiment in accordance with the present invention;

FIG. 4 is an enlarged bottom view showing the flexible spring plate member of FIG.3; and, FIGS. 5A & 5B are successive-active scheme showing the flexible spring plate member is progressively stored therein.

DETAILED DESCRIPTION OF THE INVENTION

Firstly referring to FIGS. 3 & 4, a handle assembly with a protector for luggage, includes a cave recess 31 defined above the luggage with a pulling rod 11 thereby accommodating a handle 12 of which the pulling rod 11 is retracted back. The recess 31 further has a notch 32 defined upward, and a bottom end 33 with leading edge 34 formed respectively on both lateral sides of the notch 32 for locking with a hook 203 formed with a flexible spring plate member 20 as soon as flexibly recovering. Therefore, the flexible spring plate member 20 will be not broken away because of the flexible recovery of a spring (detailed later). At least one circular aperture 301 is defined through the bottom wall of the notch 32 (See FIGS. 5A & 5B) for receiving therein a short post 201 extended from the member 20 as soon as being compressed. The flexible spring plate member 20 is located within the notch 32 and forms a hook 203 on both sides thereof. Although the hooks 203 each are shaped with a reversal triangle contour in the preferred embodiment according to the present invention, any practicable design on the shapes of both the bottom ends and the hooks, which functions in latch and separation therebetween, is not excluded. An upper plate portion 205 is fixed with at least a short post 201 which a spring 202 circumambulates around. An end of the spring 202 is attached at the bottom of the upper plate portion 205. In assembly, The hooks 203 of the flexible spring plate member 20 are retentively snapped with bottom ends 33 of the notch 32. Then, each of the short posts 201 is inserted respectively into the corresponding circular aperture 301 defined downward of the notch 32. Thus, the flexible spring plate member 20 retractably falls down to balance most of applied forces thereby avoiding danger of clamping the hand hurtfully as soon as the pulling rod 11 is retracted by applying an external force on the handle 12 for accommodation of the handle 12.

As shown in FIGS. 5A & 5B, to store the handle 12 therein, a hand of a user holds the handle 12 to press it down until the hand touches the flexible spring plate member 20 located above the recess 31. The springs 202 attached under the member 20 still are compressed and therefore the posts 201 are deepened into the circular apertures 301. The entire member 20 falls downward in at least a specific distance H. As functioning as a buffer, the member 20 does not only advantageously balance most of the applied forces but the hand also can be contracted at appropriate time thereby avoiding conflict on the top of the luggage or the problem of clamping under the handle. Therefore, it is useful to reach a safety operation in accommodating the handle.

Furthermore, the flexible spring plate member 20 is made of a material identical to the top of the luggage in color. Thus, the entire luggage can appear in consistence of visional effect and is not uncomfortable in vision.

Obviously, many modifications and variations of the present invention are possible in the light of the above teachings. Thus, it is to be understood that, within the scope of the appended claims, the invention may be practiced otherwise than as specifically described above.

I claim:

1. A handle assembly with a protector for luggage, the assembly including:

a notch formed on the top of the luggage, the notch having a bottom end with leading edges on both of lateral sides thereof; and a flexible spring plate member received within the notch, and having two hooks fixed on the both lateral sides thereof, and at least a spring retained in the bottom of an upper plate portion of the member with an end of the spring fixed on the bottom surface of the upper plate portion;

in assembly, the hooks of the flexible spring plate member are retentively snapped with the associated leading edges of the notch, and the spring is disposed between the bottom of the upper plate portion of the flexible spring plate member and the bottom of the notch.

2. The handle assembly as described in claim 1, wherein the bottom of the notch is defined through with at least a circular aperture, and the upper plate portion of the flexible spring plate member is fixed with at least a post which is capable to insert through the associated aperture, and the spring circumambulates around the post.

3. The handle assembly as described in claim 1, wherein a recess including the notch is defined on the top of the luggage.

* * * * *